US006036441A

United States Patent [19]

Manning et al.

[11] Patent Number: 6,036,441

[45] Date of Patent: Mar. 14, 2000

[54] SERIES IMPINGEMENT COOLED AIRFOIL

[75] Inventors: Robert F. Manning, Newburyport; Paul J. Acquaviva, Wakefield; Daniel E. Demers, Ipswich, all of Mass.

[73] Assignee: General Electric Company, Cincinnati, Ohio

[21] Appl. No.: 09/192,225

[22] Filed: Nov. 16, 1998

[51] Int. Cl.[7] ..... F01D 5/18

[52] U.S. Cl. ..... 416/97 R; 415/115; 416/96 R; 416/97 A; 416/96 A

[58] Field of Search ..... 415/115; 416/97 R, 416/96 R, 97 A, 96 A

[56] References Cited

U.S. PATENT DOCUMENTS

| | | | |
|---|---|---|---|
| 3,094,310 | 6/1963 | Bowmer | 416/96 A |
| 3,806,276 | 4/1974 | Aspinwall | 416/97 |
| 5,246,340 | 9/1993 | Winstanley et al. | 416/97 R |
| 5,263,820 | 11/1993 | Tubbs | 416/97 R |
| 5,356,265 | 10/1994 | Kercher . | |
| 5,387,085 | 2/1995 | Thomas, Jr. et al. . | |
| 5,498,133 | 3/1996 | Lee . | |
| 5,591,007 | 1/1997 | Lee et al. . | |
| 5,660,524 | 8/1997 | Lee et al. | 416/97 R |
| 5,702,232 | 12/1997 | Moore | 416/95 |
| 5,779,437 | 7/1998 | Abdel-Messeh et al. | 415/115 |

OTHER PUBLICATIONS

U.S. Patent Application, "Airfoil Isolated Leading Edge Cooling," by R.F. Manning et al, filed concurrently herewith (Docket 13DV–12492).

*Primary Examiner*—Edward K. Look
*Assistant Examiner*—Matthew T. Shanley
*Attorney, Agent, or Firm*—Andrew C. Hess; Rodney M. Young

[57] ABSTRACT

A gas turbine engine airfoil includes first and second sidewalls joined together at opposite leading and trailing edges, and extending longitudinally from a root to a tip. The sidewalls are spaced apart from each other to define in part first and second adjoining flow chambers extending longitudinally therein, and defined in additional part by corresponding first and second partitions disposed between the sidewalls. The second partition is common to both chambers, and both partitions include respective pluralities of first and second inlet holes sized to meter cooling air therethrough in series between the chambers.

20 Claims, 2 Drawing Sheets

SERIES IMPINGEMENT COOLED AIRFOIL

BACKGROUND OF THE INVENTION

The present invention relates generally to gas turbine engines, and, more specifically, to cooled turbine blades and stator vanes therein.

In a gas turbine engine, air is pressurized in a compressor and channeled to a combustor wherein it is mixed with fuel and ignited for generating hot combustion gases. The combustion gases flow downstream through one or more turbines which extract energy therefrom for powering the compressor and producing output power.

Turbine rotor blades and stationary nozzle vanes disposed downstream from the combustor have hollow airfoils supplied with a portion of compressed air bled from the compressor for cooling these components to effect useful lives thereof. Any air bled from the compressor necessarily is not used for producing power and correspondingly decreases the overall efficiency of the engine.

In order to increase the operating efficiency of a gas turbine engine, as represented by its thrust-to-weight ratio for example, higher turbine inlet gas temperature is required, which correspondingly requires enhanced blade and vane cooling.

Accordingly, the prior art is quite crowded with various configurations intended to maximize cooling effectiveness while minimizing the amount of cooling air bled from the compressor therefor. Typical cooling configurations include serpentine cooling passages for convection cooling the inside of blade and vane airfoils, which may be enhanced using various forms of turbulators. Internal impingement holes are also used for impingement cooling inner surfaces of the airfoils. And, film cooling holes extend through the airfoil sidewalls for providing film cooling of the external surfaces thereof.

Airfoil cooling design is rendered additionally more complex since the airfoils have a generally concave pressure side and an opposite, generally convex suction side extending axially between leading and trailing edges. The combustion gases flow over the pressure and suction sides with varying pressure and velocity distributions thereover. Accordingly, the heat load into the airfoil varies between its leading and trailing edges, and also varies from the radially inner root thereof to the radially outer tip thereof.

One consequence of the varying pressure distribution over the airfoil outer surfaces is the accommodation therefor for film cooling holes. A typical film cooling hole is inclined through the airfoil walls in the aft direction at a shallow angle to produce a thin boundary layer of cooling air downstream therefrom. The pressure of the film cooling air must necessarily be greater than the external pressure of the combustion gases to prevent backflow or ingestion of the hot combustion gases into the airfoil.

Fundamental to effective film cooling is the conventionally known blowing ratio which is the product of the density and velocity of the film cooling air relative to the product of the density and velocity of the combustion gases at the outlets of the film cooling holes. Excessive blowing ratios cause the discharged cooling air to separate or blow-off from the airfoil outer surface which degrades film cooling effectiveness. However, since various film cooling holes are fed from a common-pressure cooling air supply, providing a minimum blowing ratio for one row of commonly fed film cooling holes necessarily results in an excessive blowing ratio for the others.

Accordingly, it is desired to provide a turbine airfoil having improved internal cooling notwithstanding external pressure variations therearound.

BRIEF SUMMARY OF THE INVENTION

A gas turbine engine airfoil includes first and second sidewalls joined together at opposite leading and trailing edges, and extending longitudinally from a root to a tip. The sidewalls are spaced apart from each other to define in part first and second adjoining flow chambers extending longitudinally therein, and defined in additional part by corresponding first and second partitions disposed between the sidewalls. The second partition is common to both chambers, and both partitions include respective pluralities of first and second inlet holes sized to meter cooling air therethrough in series between the chambers.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
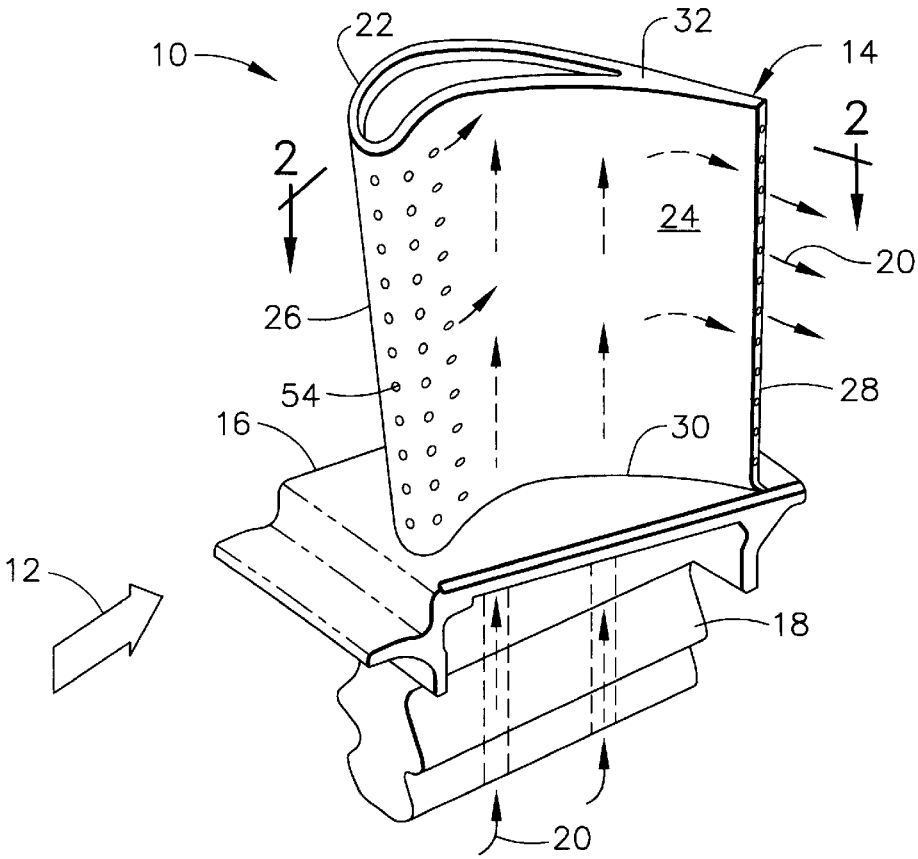
FIG. 1 is an isometric view of an exemplary gas turbine engine turbine rotor blade having an airfoil in accordance with an exemplary embodiment of the present invention.

Illustrated in FIG. 1 is a rotor blade 10 configured for attachment to the perimeter of a turbine rotor (not shown) in a gas turbine engine. The blade 10 is disposed downstream of a combustor and receives hot combustion gases 12 therefrom for extracting energy to rotate the turbine rotor for producing work.

The blade 10 includes an airfoil 14 over which the combustion gases flow, and an integral platform 16 which defines the radially inner boundary of the combustion gas flowpath. A dovetail 18 extends integrally from the bottom of the platform and is configured for axial-entry into a corresponding dovetail slot in the perimeter of the rotor disk for retention therein.

In order to cool the blade during operation, pressurized cooling air 20 is bled from a compressor (not shown) and routed radially upwardly through the dovetail 18 and into the hollow airfoil 14. The airfoil 14 is specifically configured in accordance with the present invention for improving effectiveness of the cooling air therein. Although the invention is described with respect to the airfoil for an exemplary rotor blade, it may also be applied to turbine stator vanes.

As initially shown in FIG. 1, the airfoil 14 includes a first or suction sidewall 22 and a circumferentially or laterally opposite second or pressure sidewall 24. The suction sidewall 22 is generally convex and the pressure sidewall is generally concave, and the sidewalls are joined together at axially opposite leading and trailing edges 26,28 which extend radially or longitudinally from a root 30 at the blade platform to a radially outer tip 32.

Figure 2:
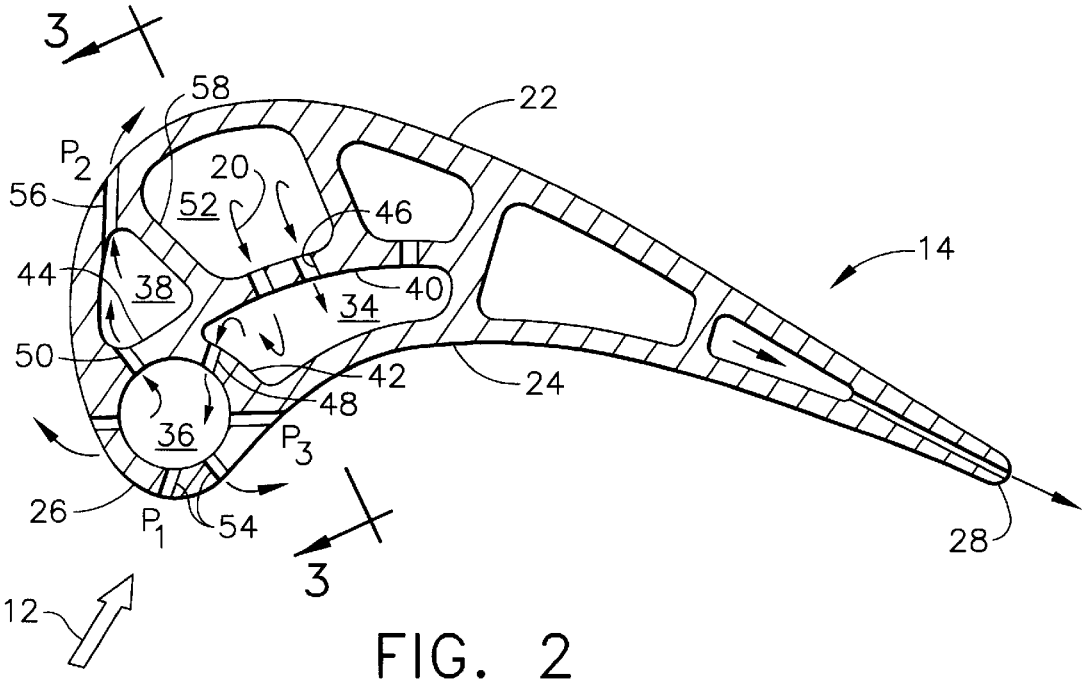
FIG. 2 is a radial sectional view through the airfoil illustrated in FIG. 1 and taken along line 2—2.

An exemplary radial section of the airfoil is illustrated in more detail in FIG. 2 and has a profile conventionally configured for extracting energy from the combustion gases 12. For example, the combustion gases 12 first impinge the airfoil 14 in the axial, downstream direction at the leading edge 26, with the combustion gases then splitting circumferentially for flow over both the suction sidewall 22 and the pressure sidewall 24 until they leave the airfoil at its trailing edge 28.

At the airfoil leading edge, the combustion gases 12 develop a maximum static pressure $P_1$, with the pressure then varying correspondingly along the suction and pressure sidewalls. Due to the convex shape of the suction sidewall 22, the combustion gases are accelerated therearound to increase velocity thereof with a corresponding reduction in pressure, with an exemplary pressure $P_2$ located downstream of the leading edge on the suction sidewall being substantially lower than the maximum pressure at the leading edge.

Similarly, the concave shape of the pressure sidewall also controls the velocity of the combustion gases as they flow downstream or aft thereover with an exemplary pressure $P_3$ being less than the maximum pressure at the leading edge and greater than the corresponding pressure $P_2$ on the opposite convex side. The pressure profile along the suction sidewall 22 is substantially less in magnitude than the pressure profile along the pressure sidewall 24 to provide an aerodynamic lifting force on the airfoil for rotating the supporting turbine rotor to produce work.

The cooling air 20 is provided to the airfoil typically at a single source pressure which is sufficiently high for driving the cooling air through various cooling circuits inside the airfoil and then being discharged through the airfoil into the turbine flowpath in which the combustion gases flow. Since the pressure and velocity profiles of the combustion gas flowing over the airfoil suction and pressure sidewalls varies, the differential pressure between the cooling air supplied inside the airfoil and the combustion gases flowing outside the airfoil correspondingly varies.

As indicated above, the blowing ratio of the cooling air discharged through holes in the airfoil may correspondingly vary and affect the cooling effectiveness of the discharged cooling air. This is most critical at the airfoil leading edge which experiences the maximum static pressure in the combustion gases with a steep gradient reduction in pressure along the suction sidewall near the leading edge, which like the leading edge itself requires effective cooling for acceptable blade life.

As shown in FIG. 2, the two sidewalls 22,24 are spaced apart circumferentially or laterally from each other to define in part first, second, and third flow chambers 34,36,38 extending radially or longitudinally therein, and defined in additional part by corresponding first, second, and third internal radial partitions 40,42,44 disposed between the sidewalls. The second partition 42 is common to both the first and second chambers 34,36, and similarly, the third partition 44 is common to both the second and third chambers 36,38.

Each of the partitions includes a respective plurality of first, second, and third inlet holes 46,48,50 arranged in one or more longitudinal rows. The inlet holes are sized in accordance with the present invention to meter the cooling air 20 therethrough in series between the respective flow chambers 34,36,38 in turn for maximizing the cooling effectiveness thereof.

Each of the partitions 40,42,44 preferably faces respective inner surfaces of at least one of the airfoil sidewalls with the corresponding inlet holes being directed thereat for impingement cooling the sidewalls with the successively used cooling air channeled therethrough. In this way, the airfoil has enhanced cooling due to channeling the same cooling air obliquely between the sidewalls thereof in series impingement therein.

Figure 3:
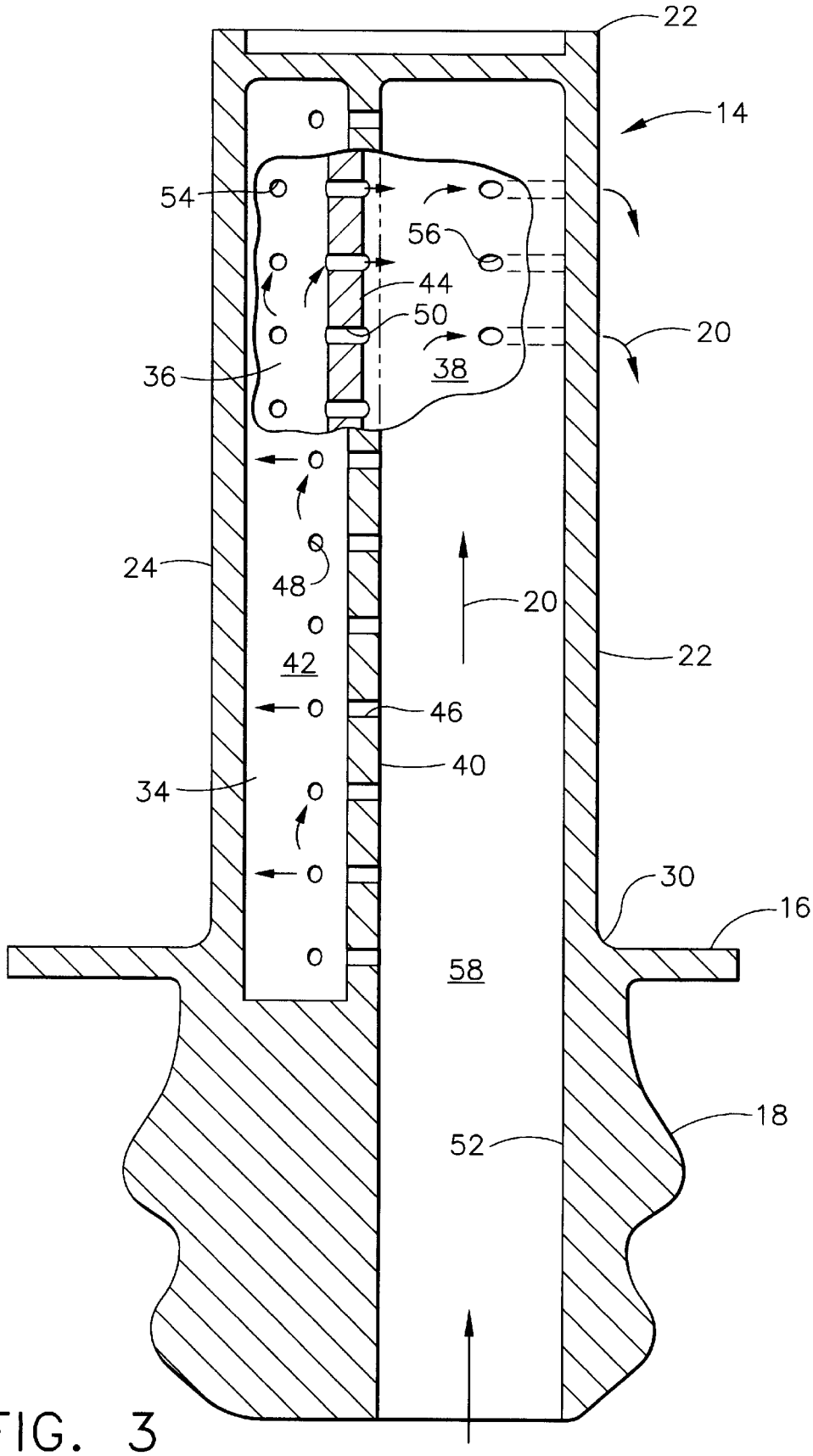
FIG. 3 is an elevational sectional view through the airfoil illustrated in FIG. 2 and taken along line 3—3.

In the exemplary embodiment illustrated in FIGS. 2 and 3, the three chambers 34–38 are closed top and bottom and initially receive the cooling air from an inlet channel 52 extending longitudinally along the first partition 40 for initially supplying the cooling air to the first chamber 34 through the first inlet holes 46 arranged in two exemplary radial rows. The inlet channel 52 receives the cooling air from the blade dovetail with maximum pressure, minimum temperature, and suitable flowrate for flow through the airfoil.

The three sets of inlet holes 46–50 extend obliquely through the respective partitions 40–44 generally perpendicularly therethrough in the radial section or plane illustrated in FIG. 2 to discharge corresponding jets of the cooling air 20 in impingement against opposite walls of the respective chambers. In this way, the same cooling air is successively used for effecting series impingement in three discrete steps, with the temperature of the cooling air in each step increasing as it picks up heat from the airfoil, and the pressure thereof decreasing in each step after being metered through the corresponding inlet holes.

The same cooling air is therefore used multiple times before being discharged from the airfoil, which therefore increases cooling efficiency and allows either a reduction in the required cooling air flowrate, or permits a higher temperature of the combustion gases 12. The cooling capability of the cooling air is thus more fully utilized since it is not simply discharged from the airfoil after a single impingement cooling operation.

In the exemplary embodiment illustrated in FIG. 2, the first partition 40 is preferably disposed generally parallel between the opposite sidewalls 22,24 generally along a chordal line in the mid-chord region of the airfoil behind the leading edge. The first inlet holes 46 are disposed generally perpendicular therein for impinging the cooling air against the inner surface of the second, or pressure sidewall 24. The portion of the pressure sidewall adjoining the first chamber 34 is preferably imperforate and is primarily cooled by internal impingement cooling thereof.

The second partition 42 is preferably disposed obliquely to both the pressure sidewall 24 and the first partition 40, with the second chamber 36 being disposed directly behind the leading edge 26 for defining a leading edge flow chamber. The first chamber 34 is thusly disposed directly aft of the leading edge chamber 36 along the pressure sidewall 24 in the airfoil midchord region.

The third partition 44 preferably extends between the first sidewall 22 downstream from the leading edge 26 and intersects both the first and second partitions 40,42. The third inlet holes 50 extend obliquely through the third partition 44 to discharge jets of the cooling air in impingement against the inner surface of the first sidewall 22.

As shown in FIG. 2, the second sidewall 24 is imperforate at the first chamber 34, and the leading edge 26 includes a plurality of film cooling holes 54 extending therethrough in a plurality of axially spaced apart rows, and disposed in flow communication with the second chamber 36 for discharging cooling air therefrom for film cooling the airfoil leading edge. The leading edge film cooling holes 54 may have any conventional configuration such as conical diffusion holes for increasing film coverage and effectiveness while reducing the required amount of coolant flow.

The first sidewall 22 preferably includes a plurality of film cooling gill holes 56 extending therethrough in flow communication with the third chamber 38 for discharging the cooling air therefrom for film cooling the first sidewall 22 downstream therefrom. The gill holes 56 may have any conventional configuration such as fan diffusion film holes for maximizing film cooling effectiveness thereof.

In this way, the three chambers 34,36,38 are arranged for effecting series impingement cooling in three discrete steps, and film cooling in only two steps following the ultimate and penultimate ones of the impingement steps. The airfoil sidewalls are impingement cooled at each of the three chambers 34,36,38, and film cooling is effected from the leading edge 26 downstream therefrom along both the first sidewall 22 and the second sidewall 24 in the leading edge region subject to high heat loads which require effective cooling. The gill holes 56 which finally discharge the series impingement air re-energizes the film cooling layer from the leading edge on the first sidewall 22, which film extends downstream therefrom for a suitable distance toward the trailing edge 28.

Similarly, the multiple rows of leading edge film cooling holes 54 protect the airfoil leading edge and re-energize the film cooling boundary from row to row, and in particular along the second sidewall 24. The film cooling air discharged from the last row of leading edge holes flows along the second sidewall 24 along the first chamber 34 for providing film cooling in this region in addition to the internal impingement cooling thereof.

In the preferred embodiment illustrated in FIG. 2, the third chamber 38 is defined in additional part by a fourth partition 58 which provides a common wall with the inlet channel 52. The fourth partition 58 is preferably imperforate and effectively isolates the third chamber 38 from the high pressure cooling air 20 initially introduced through the inlet channel 52. The cooling air 20 is provided to the third chamber 38 only after firstly passing from the inlet channel 52 to the first and second chambers 34,36 in turn. As the cooling air is metered in turn through the first, second, and third inlet holes 46,48,50 it experiences a significant pressure drop in steps. The cooling air channeled in the third chamber 38 is therefore at a substantially lower pressure than the cooling air initially provided in the inlet channel 52.

This is significant for improving the blowing ratio of the cooling air across the gill holes 56 as compared with the leading edge holes 54. Since a substantial pressure drop occurs in the combustion gases 12 downstream along the suction sidewall 22 from the leading edge 26, higher pressure cooling air is required in the leading edge chamber 36 for effecting a suitable blowing ratio across the leading edge holes 54 than is required in the third chamber 38 for obtaining a suitable blowing ratio across the gill holes 56. In this way, the pressure of the supplied cooling air in the second and third chambers 36,38 may be more optimally matched with the corresponding different static pressure in the combustion gases 12 disposed outside thereof for maximizing the effectiveness of film cooling without excessive blow-off margins.

The series impingement of the same cooling air 20 therefore more effectively utilizes that air prior to being discharged from the airfoil which increases the cooling efficiency thereof. This is particularly important for cooling the leading edge region of the airfoil subject to high heat load input from the combustion gases 12 which first engage the airfoil.

As shown in FIG. 2, the airfoil may also include additional flow channels disposed between the midchord region and the trailing edge 28 which may be configured in any conventional manner for cooling these regions of the airfoil as desired. Although the series impingement cooling configuration disclosed above is preferably located between the leading edge and midchord region of the airfoil, it may be otherwise configured to advantage for maximizing the cooling effectiveness of the supplied cooling air 20.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which

We claim:

1. A gas turbine engine airfoil comprising:

first and second sidewalls joined together at opposite leading and trailing edges, and extending from a root to a tip;

said sidewalls being spaced apart from each other to define in part first and second adjoining flow chambers extending longitudinally therein, and defined in additional part by corresponding first and second partitions disposed between said sidewalls, with said second partition being in common with both said chambers, and obliquely joining said first partition; and said first and second partitions including a plurality of first and second inlet holes, respectively, sized to meter cooling air therethrough in series impingement in said chambers.

2. A gas turbine engine airfoil comprising:

first and second sidewalls joined together at opposite leasing and trailing edges, and extending from a root to a tip;

said sidewalls being spaced apart from each other to define in part first and second adjoining flow chambers extending longitudinally therein, and defined in additional part by corresponding first and second partitions disposed between said sidewalls, with said second partition being in common with both said chambers, and obliquely joining said first partition;

said first and second partitions including a plurality of first and second inlet holes, respectively, sized to meter cooling air therethrough in series impingement in said chambers; and an inlet channel extending longitudinally along said first partition for supplying said cooling air to said first chamber through said first inlet holes.

3. An airfoil according to claim 2 wherein said first and second inlet holes extend obliquely through said partitions to discharge jets of said cooling air in impingement against opposite walls of said chambers.

4. An airfoil according to claim 3 wherein said partitions face respective inner surfaces of at least one of said sidewalls for impingement cooling thereof by said inlet holes.

5. An airfoil according to claim 4 wherein said first partition is disposed generally parallel between said sidewalls, and said first inlet holes are disposed generally perpendicular therein for impinging said cooling air against said second sidewall.

6. An airfoil according to claim 5 wherein said second partition is disposed obliquely to both said second sidewall and said first partition.

7. An airfoil according to claim 6 wherein said second chamber is disposed directly behind said leading edge, and said first chamber is disposed aft therefrom.

8. An airfoil according to claim 7 further comprising a third flow chamber adjoining said second chamber, and defined in part by a third partition extending in common therebetween, with said third partition having a plurality of third inlet holes sized to meter said cooling air from said second chamber into said third chamber.

9. An airfoil according to claim 8 wherein:

said first sidewall is a convex, suction sidewall;

said second sidewall is a concave, pressure sidewall;

said third partition extends between said first sidewall and said first and second partitions; and said third holes extend obliquely through said third partition to discharge jets of said cooling air in impingement against said sidewall.

10. An airfoil according to claim 9 wherein:

said second sidewall is imperforate at said first chamber;

said leading edge includes a plurality of film cooling holes extending in flow communication with said second chamber for discharging cooling air therefrom; and said first sidewall includes a plurality of film cooling holes extending in flow communication with said third chamber for discharging cooling air therefrom.

11. A method of cooling a gas turbine engine airfoil comprising:

channeling cooling air obliquely between opposite pressure and suction sidewalls thereof in series impingement therein, with corresponding pressure drops; and discharging said air through said suction sidewall in rows of cooling air films downstream from a leading edge of said airfoil with corresponding decreasing pressure between said row for reducing difference in blowing ratio therebetween.

12. A method according to claim 11 further comprising channeling said cooling air in series between a plurality of laterally adjoining flow chambers.

13. A method according to claim 12 further comprising discharging said cooling air from two of said chambers for film cooling said airfoil downstream therefrom for reducing said blowing ratio difference therebetween.

14. A method according to claim 13 further comprising effecting said series impingement in three steps, and said film cooling in two steps following ultimate and penultimate ones of said impingement steps.

15. A gas turbine engine airfoil comprising:

first and second sidewalls joined together at opposite leading and trailing edges, and extending from a root to a tip;

said sidewalls being spaced apart from each other to define in part a pair of adjoining flow chambers extending longitudinally therein, and defined in additional part by corresponding partitions including a common partition positioning a leading edge one of said chambers directly behind said leading edge and a first-side one of said chambers disposed aft therefrom along only said first sidewall; and each of said partitions including a row of inlet holes sized to meter cooling air therethrough in series impingement in said chambers.

16. An airfoil according to claim 15 further comprising a second-side one of said flow chambers disposed aft of said leading edge chamber along said second sidewall, and having a common partition therewith including another row of inlet holes therein sized to meter cooling air therethrough in series impingement with said other rows of inlet holes.

17. An airfoil according to claim 16 further comprising:

a row of film cooling holes disposed through said second sidewall in flow communication with said leading edge chamber; and another row of film cooling holes disposed through said second sidewall in flow communication with said second-side chamber.

18. An airfoil according to claim 17 wherein said airfoil second sidewall is a convex suction sidewall, and said inlet holes are sized to meter air in series through said chambers to decrease pressure thereof to reduce blowing ratio difference between said rows of film cooling holes at said leading edge chamber and said second-side chamber.

19. An airfoil according to claim 18 further comprising an inlet channel adjoining both said first-side and second-side chambers, and disposed in flow communication with said inlet holes for said first-side chamber for supplying said cooling air thereto.

20. An airfoil according to claim 19 wherein said second-side chamber is isolated from said inlet channel, and is disposed solely in flow communication with said leading edge chamber for receiving said air therefrom.

* * * * *